United States Patent [19]

Suchecki

[11] 3,970,233

[45] July 20, 1976

[54] MACHINE AND A METHOD FOR FABRICATING A HELICOIDAL TUBE

[76] Inventor: Josef Suchecki, 4, Sussex Lane, Bethpage, N.Y. 11714

[22] Filed: Nov. 5, 1975

[21] Appl. No.: 628,889

[52] U.S. Cl. ..... 228/17.5; 228/146; 72/137; 72/140; 72/52; 29/160.6

[51] Int. Cl.² ..... A44C 27/00; B21C 1/08; B21D 5/10

[58] Field of Search ..... 29/160.6; 228/17.5, 228/146–152; 72/52, 142, 137, 144

[56] References Cited

UNITED STATES PATENTS

| | | | |
|---|---|---|---|
| 456,059 | 7/1891 | Prentice | 72/52 |
| 921,722 | 5/1909 | Meyer | 29/160.6 |
| 1,488,585 | 4/1924 | Bundy | 228/146 X |
| 1,892,607 | 12/1932 | Bundy | 228/254 X |
| 2,229,149 | 1/1941 | Wacker | 72/137 |
| 2,229,462 | 1/1941 | Kurtz | 72/137 |

*Primary Examiner*—Al Lawrence Smith
*Assistant Examiner*—K. J. Ramsey
*Attorney, Agent, or Firm*—Erwin S. Teltscher

[57] ABSTRACT

A machine for fabricating a helicoidal tube from a longitudinal flat and bendable strip includes a frame, and tube-forming means disposed on the frame for receiving the longitudinal flat strip. The strip is then formed into a tube which has a seam. Helicoid-forming means are disposed on the frame for receiving the tube and for the forming thereof into a helicoid.

10 Claims, 11 Drawing Figures

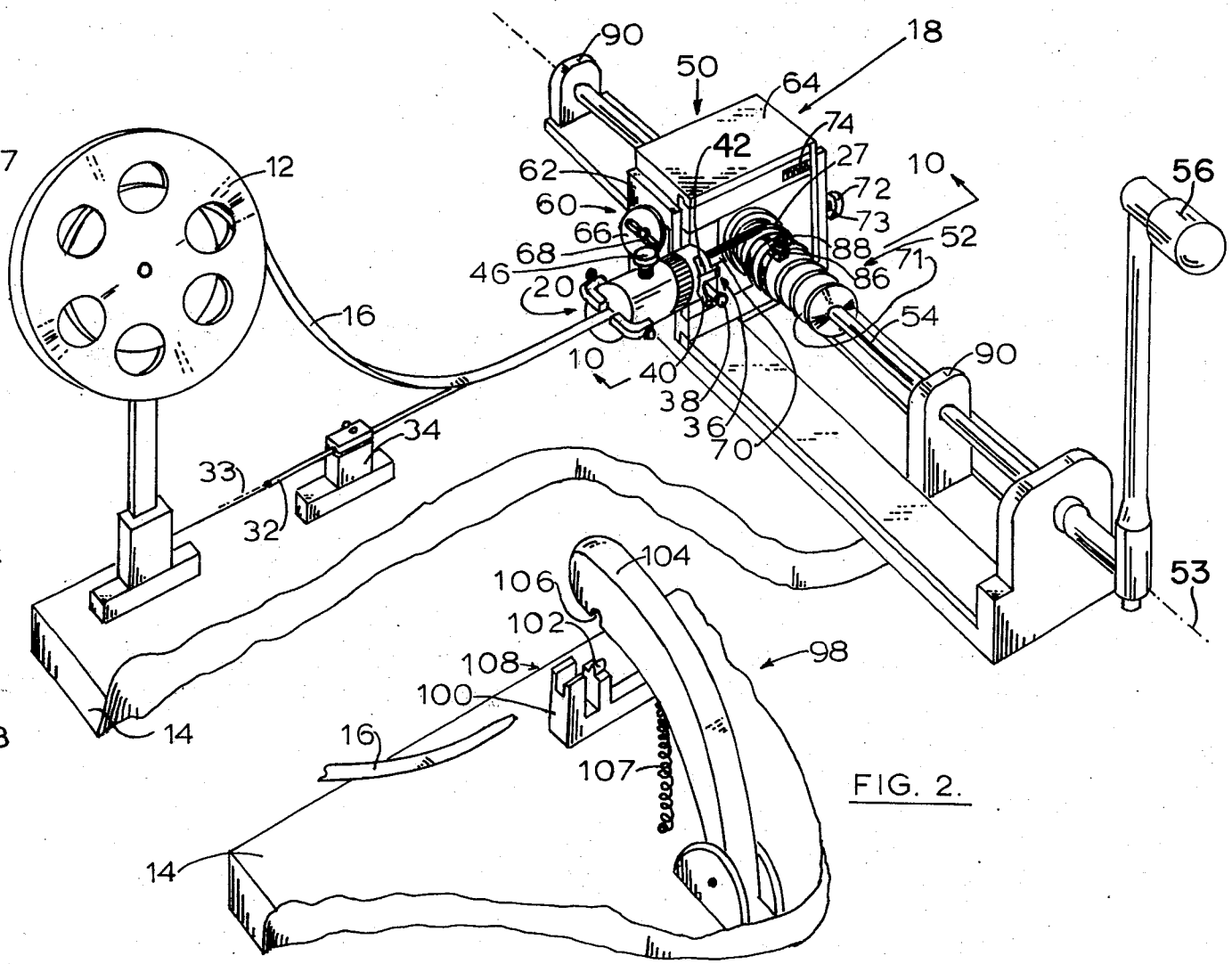
FIG. 1
FIG. 2.
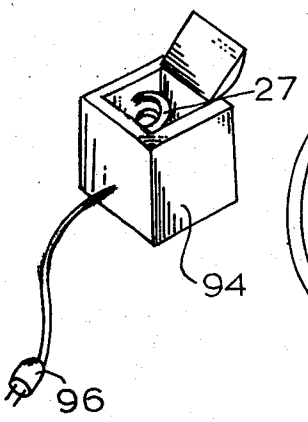
FIG. 3.
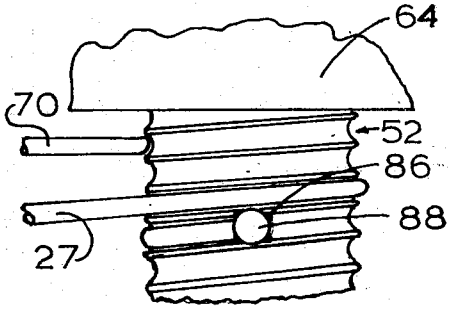
FIG. 11

MACHINE AND A METHOD FOR FABRICATING A HELICOIDAL TUBE

BACKGROUND OF THE INVENTION

1. Field of the Invention

The field of the invention relates to a machine for fabricating a helicoidal tube from a longitudinal flat and bendable strip.

2. Description of the Prior Art

Helicoidal tubes, such as tubes of gold, have been formed by bending rods or bars of the precious metal into a helicoidal shape. As the price of gold kept increasing, a strip of gold was bent around a longitudinal bar of copper, and the copper was then dissolved in a bath of acid, leaving an outer hull made of gold. This method proved very time consuming and inconvenient, and new means were therefore sought for fabricating hollow gold tubes.

SUMMARY OF THE INVENTION

It is therefore an object of the present invention to devise means for forming a helicoidal tube from a longitudinal flat and bendable strip of, for example, gold or silver, by a relatively inexpensive and straightforward method without the inconvenience of immersing a copper strip having a flat gold strip wound therearound into an acid bath or the like, and waiting for the copper to be dissolved in that bath. It is another object of the present invention that the cross-section of the finished helicoidal tube may have any desired polygonal shape, such as a square, a pentagon, a hexagon or a circle.

I accordingly provide a machine for fabricating a helicoidal tube from a longitudinal flat and bendable strip which includes a frame, tube-forming means disposed on the frame for receiving the longitudinal flat strip and for the forming thereof into a tube having a seam, and helicoid-forming means disposed on the frame for receiving the tube, and for the forming of the latter into a helicoid.

This strip preferably includes heat-responsive means, and the machine additionally includes heat-treatment means for applying the heat-responsive means to the tube for the closing thereof. Strip-feeding means, preferably in the form of a reel disposed on the frame, are provided for feeding the longitudinal flat strip to the tube-forming means.

The tube-forming means includes a first element formed with a longitudinal slit for receiving the strip, and a second element formed with a tapered opening having widest and narrowest wall portions; the narrowest wall portion of the second element faces the slit, and the widest wall portion of the second element has inner dimensions which just exceed the outer dimensions of the tube. A holder is additionally provided for holding the first and the second elements in alignment, so that the longitudinal strip is substantially centered with respect to the cross-section of the second element. A yieldably resilient member interposed between the first and second elements, and a longitudinal guide member, which has a first longitudinal axis, is clamped to the frame and passes through the first and second elements for guiding the strip around the guide member. Adjustment means are disposed on the holder for adjusting the position of the second element with respect to the first element.

The helicoidal-forming means includes a rotatable mandrel of substantially circular cross section which has a second longitudinal axis. The second longitudinal axis is disposed at right angles to the first longitudinal axis. Drive means are attached to the mandrel for the rotation thereof; and adjustment means are attached to the tube-forming means for the aligning thereof with respect to the mandrel so as to align the tubes substantially tangentially with the diameter of the mandrel. Additionally adjustable clamping-means are disposed on the mandrel for clamping an initial portion of the tube thereon.

The strip is preferably a solderable metal, and the heat responsive means is preferably solder. The heat-treatment means is a heat source for applying the solder to the seam.

The mandrel is formed with a groove shaped to substantially fit the circumference of the tube, and in a preferred form of my invention the drive means is a handle. Slit adjustment means are additionally provided for adjusting the width and the length of the slit.

Strip bending means can optionally be provided for forming an initial portion of the strip into a substantially U-shaped portion for the feeding of the strip into the slit. In the latter case, the slit has a substantially semi-circular shape. The method of forming a longitudinal, flat and bendable strip into a seamless helicoidal tube then includes the steps of: tapering an initial portion of the strip, guiding the strip by means of a longitudinal guide rod to the guiding element formed with a slit, bending an initial part of the strip received from the guiding element into a U-shaped portion, passing the U-shaped portion over the longitudinal guide rod through a shaping element for forming the strip into a tube having a longitudinal seam, rotationally align the position of the shaping element with respect to a grooved mandrel, windingly guiding the aligned tube over the grooved mandrel to give the tube a helicoidal shape, applying a heat-responsive material to the seam of the tube, and heating the tube and the heat-responsive material for closing the seam of the tube.

BRIEF DESCRIPTION OF THE DRAWING

My invention will be better understood with reference to the accompanying drawing in which:

FIG. 1 is a perspective view of the machine according to my invention;

FIG. 2 is a perspective view of an optional device for bending an initial portion of the strip prior to the feeding thereof into a shape forming element;

FIG. 3 shows the closing of a seam of a helicoidal tube by heat treatment means;

FIG. 11 shows a plan view of the tube passing over a portion of the mandrel, as seen along the direction of the arrows 11 in FIG. 10.

DESCRIPTION OF THE PREFERRED EMBODIMENT

Figure 4:
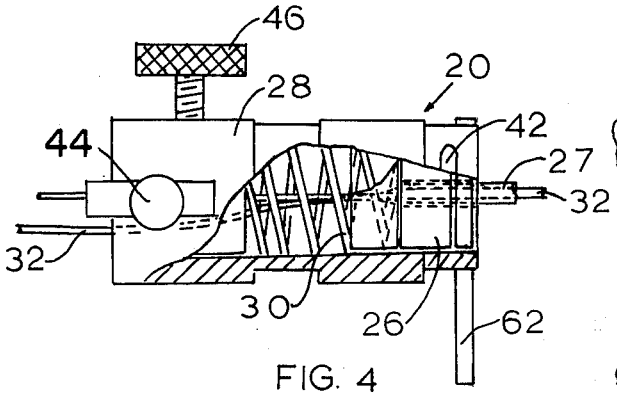
FIG. 4 shows an elevational view of the tube-forming means in part cross section.
Figure 5:
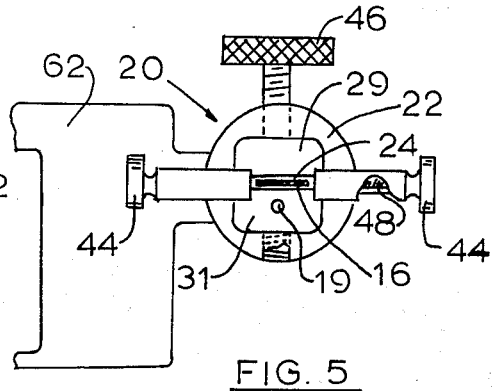
FIG. 5 shows a side-elevational view of the tube-forming means.
Figure 6:
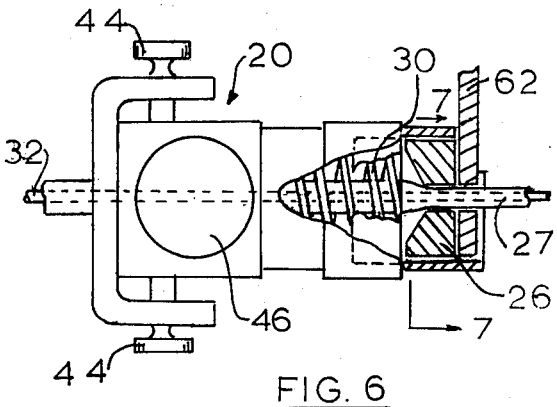
FIG. 6 shows a plan view of the tube-forming means in part cross section.
Figure 7:
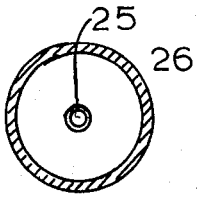
FIG. 7 shows a section of the tube-forming means along the line 7—7 of FIG. 6.

Referring now to the drawing, a reel 12 is attached to a frame 14 and adapted for feeding a longitudinal flat and bendable strip 16 to a helicoidal tube-forming machine 18. The strip 16, which may vary in thickness from about 0.002 to about 0.025 inches, is first fed into a tube-forming means 20 of the machine, which includes a first element 22 formed with a slit 24. A second element 26 is formed with a tapered opening or recess 25. The widest wall portion of the element 26 has inner dimensions, e.g. an inner diameter, just exceeding the outer dimensions, e.g. an outer diameter of a tube 27, which is being formed within the element 26, and the narrowest wall portion of the element 26 faces the slit 24. The narrowest cross-section of the tapered recess 25 determines the final shape of the tube 27 to emerge therefrom, and the cross-sectional shape of the tube 27 may therefore have any desired shape, and is only a function of the shape selected for the narrowest cross-section of the recess 25. A holder 28 holds the elements 22 and 26 in alignment, so that the longitudinal strip is substantially centered with respect to the cross section of the element 26. A yieldably resilient member in the form of a spring 30 is interposed between the first element 22 and the second element 26. A longitudinal guide member in the form of a rod 32, which has a longitudinal axis 33, is clamped by means of a holder 34 to the frame 14, and passes through an opening 19 formed in the first element 22, and the second element 26 for guiding the strip 16 therearound; the rod 32 extends within the tube 27 up to the tangential contact of the latter with a mandrel 52. Adjustment means 36 in the form of a thumb screw 38 fix to element 26, a wing nut 40 to look screw 38 in position and a slot 42 formed in a holder 28 permit a rotational alignment or adjustment of the second element 26, as well as an adjustment in an axial direction with respect to the first element 22. A plurality of elements 26 may be cascaded in series. Knurled knobs 44 and 46 are provided for adjusting the lengths and widths, respectively, of the slit 24. Each knurled knob 44 is turned against the force of a compression spring 48 to permit a more accurate adjustment of the length of the slit 24. The element 22 includes upper and a lower spring-loaded parts 29 and 31 fitted thereinto, respectively, and the knurled knob 46 permits the adjustment of the upper part 29 with respect to the lower part 31 of the element 22, so as to adjust the width of the slit 24. The machine includes helicoid-forming means 50 inclusive of the rotatable mandrel 52 of substantially circular cross section, which has a second longitudinal axis 53 disposed substantially at right angles with the first longitudinal axis 33 of the guide member 32.

Drive means in the form of an axle 54 are concentrically attached to the mandrel 52 and the axle 54 may be provided with a handle 56 for rotating the mandrel 52, or may also be provided with a motor, such as an electric motor, for the drive thereof. The strip 16 emerges from the tube-forming means 20 as a tube 27, and is made to pass tangentially over the mandrel 52. Adjustment means 60 in the form of a bracket 62 slidable along one side of a housing 64 permit upward, downward, and lateral adjustment of the tube-forming means 28, so as to align the latter with respect to the mandrel 52. A circular plate 66 is clampable over the bracket 62 by means of a wing nut 68 to secure the aligned position of the tube-forming means 20 with respect to the mandrel 52.

The mandrel 52 is freely slidable in an axial direction through the housing 64 for the purposes of assembly and disassembly of the mandrel. During operation of the device, adjustable guide means in the form of a cam or plate 70 permitting tangential contact with the mandrel 52 are slidably movable into a helicoidal groove 71 formed in the mandrel 52 for translational guidance of the mandrel 52 upon rotation thereof. The plate 70 is laterally movable by means of a knurled knob 72, having a threaded shaft 73, the latter being rotatable against the action of two compression springs 74 urging a motion of the plate 70 in a direction away from the mandrel 52. The plate 70 is clampable into a position by a wing nut 76 and is attached to a bracket member 78 which is slidable in two T-shaped grooves 80 formed in the housing 64. The groove 71 formed in the mandrel 52 is shaped to receive not only the plate 70, but also to substantially fit the circumference of the tube 27. It is essential for the proper operation of the machine that the tube 27, when emerging from the tube-forming means 20, be disposed substantially at right angles with the axis 53 of the mandrel 52, and that the tube 27 nestle tangentially within the groove 71 and also be aligned therewith, if the tube 27 and the groove 71 have a non-circular cross-section. Each mandrel 52 has a separate plate or cam 70 fittingly associated therewith, and may vary in axial length from about 1 to about 24 inches; it can have any desired diameter, the diameter being a function of the desired diameter of a coil of the finished tubing 27.

The operation of the device is then as follows: An initial length of the strip 16 is tapered by cutting off respective side portions therefrom. The tube-forming means 20 is then disassembled and the initial tapered length of the strip 16 is guided by means of a longitudinal guide rod 32 towards the slit 24 of the element 22. The initial portion or length of the strip 16 is then formed into an approximately U-shaped portion by bending it to the U-shape by means of pliers or the like. The bent U-shaped portion of the strip 16 is then passed through a recess 25 in the element 26 and pulled therethrough by means of the pliers. The shape of the tubing 27 is dependent on the shape of the narrowest cross-section of the recess 25, and that shape can be circular or polygonal or have any other desired shape. While the strip 16 is passed through the recess 25 it is also guided by the guide rod 32 within the recess 25 thus providing at all times a close fit to the walls of the element 26. Upon the strip 16 having been shaped into a tube 27, the tube-forming means 20 is now tangentially aligned with the mandrel 52 in the precise fashion previously described. The tubing 27 is then clamped onto the mandrel 52 by means of a clamp 86, which has a knurled knob 88 disposed thereon for adjusting the holding force of the clamp 86 on the tube 27, and the handle 56 is now rotated so as to move in an outward direction from the housing 64 and hence to form a desired length of the tubing 27 around the mandrel 52. The mandrel 52 is then disassembled from the machine by loosening of the supports 90 which provide longitudinal guidance for the mandrel 52 and by loosening of the plate or cam 70 from the mandrel 52; the latter is then slid out from the housing 64 in a direction away from the handle 56, and the coiled tubing 27 is then cut off from the reel 12 and removed from the machine. Since the tubing 27 has been bent into a circular or near-circular shape in the machine, a seam is left in the tubing. This seam can be closed by applying heat to the tubing 27 by inserting the latter into an oven 94. Since the strip 16 has normally a solder or the like applied on one side thereof, it is merely necessary to allow the tube 27 to be heated in the electrical oven 94 for a predetermined time. The tubing 27 is then allowed to cool, and therefore becomes seamless. It is, of course, understood that the helicoidal tubing 27 can be cut into an annulus or ring, and the ends of such a ring can be closed.

It is alternately possible to automatize the above-described operation wherein an initial portion of the tape 16 is bent into a U-shaped portion. This can be accomplished by strip-bending means 98 illustrated in FIG. 2. A die 100 will be seen attached to the frame 14 which has on the top thereof a semi-circular protusion 102. A pivotable lever 104 is hingably attached to the frame 14, a spring 107 urging the lever 104 to remain in an upward position at a distance from the frame 14. A recess 106 formed in the handle 104 fits the contour of the projection 102.

Figure 8:
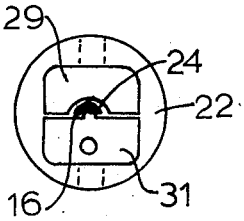
FIG. 8 shows an alternate version of a part of the tube-forming means.
Figure 9:
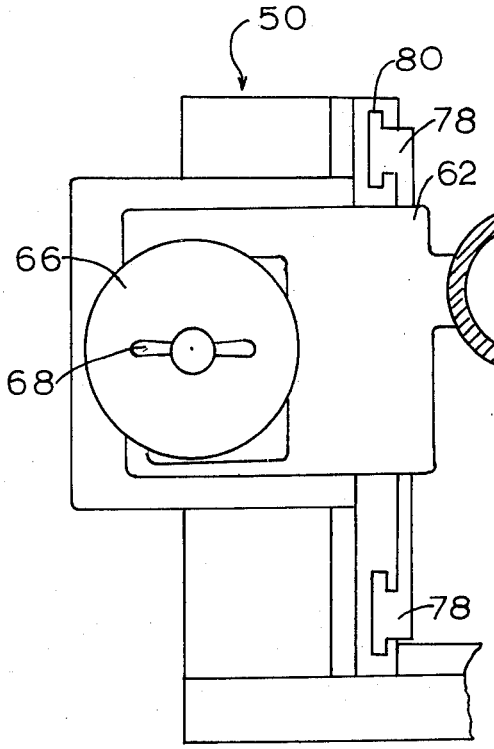
FIG. 9 shows a side elevational view of the helicoid-forming means.
Figure 10:
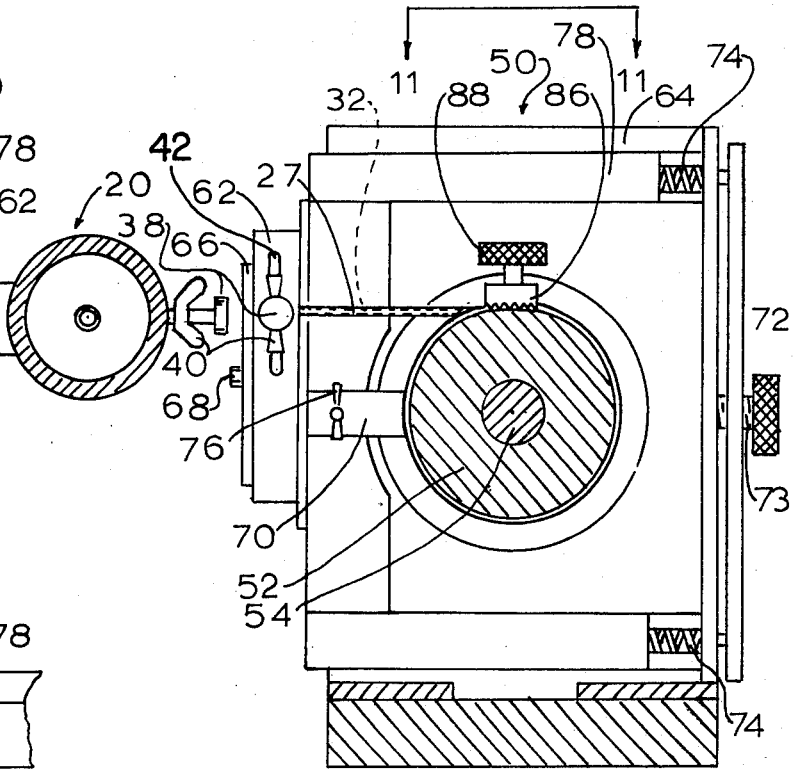
FIG. 10 shows an elevational view of the helicoid-forming means in part section along the line 10—10 of FIG. 1.

In order to use the strip-bending means 98, the element 22 has to be formed with a roughly semi-circular slit 24, in lieu of a longitudinal slit 24, and this is shown in FIG. 8. In this alternate version of my invention the reel 12 carries a strip 16 which is already preformed with a tapered end. This tapered end portion of the strip 16 is then passed into a guidance member 108 of the holder 100, and placed on the projection 102. The handle 104, which is formed with a recess 106 is thereupon forcibly lowered on the projection 102 having the initial portion of the strip 16 interposed therebetween, and upon lifting of the handle 104 that initial portion of the strip 16 is bent into a semi-circular shape or the like. This initial portion of the strip 16 is then passed through the semi-circular opening or slit 24 in the modified version of the element 22 shown in FIG. 8, and is then pulled, in the previously described fashion, through the recess 25 formed in the element 26. The rest of the operation is identical to the one previously described.

Although the invention has been described with respect to a preferred form thereof, it is to be understood that it is not to be so limited since changes can be made therein which are within the full intended scope of this invention as defined by the appended claims.

What is claimed is:

1. A machine for fabricating a helicoidal tube from a longitudinal flat and bendable strip comprising:

a frame;

tube-forming means disposed on said frame for receiving the longitudinal flat strip and for the forming thereof into a tube having inner and outer dimensions and formed with a seam, said tube-forming means including:

a first element formed with a slit for receiving said strip;

a second element formed with a tapered opening and having widest and narrowest wall portions, said narrowest wall portion of said second element facing said slit, said widest wall portion of said second element having inner dimensions just exceeding the outer dimensions of said tube;

a holder for holding said first and second element in alignment so that said longitudinal strip is substantially centered with respect to the cross-section of said second element;

a hollow member interposed between said first and second elements;

a longitudinal guide member having a first longitudinal axis, clamped to said frame and passing through said first and second elements for guiding said strip around said guide member; and adjustment means disposed on said holder for adjusting the position of said second element with respect to said first element; and helicoid-forming means disposed on said frame for receiving said tube and for the forming of the latter into a helicoid.

2. A machine according to claim 1 wherein said hollow member is a yieldably resilient member and wherein the position of said second element is rotationally adjustable within said holder.

3. A machine according to claim 1 wherein the strip includes heat-responsive means, and further comprising heat-treatment means for applying said heat-responsive means to said tube for the closing thereof.

4. A machine according to claim 3 wherein the strip is a solderable metal, said heat-responsive means is solder, and said heat-treatment means is a heat-source means for applying the solder to the seam.

5. A machine according to claim 1 further comprising strip-feeding means disposed on said frame for feeding the longitudinal flat strip to said tube-forming means.

6. A machine according to claim 1 further comprising slit adjustment means for adjusting the width and length of said slit formed in said first element and wherein said strip-feeding means is a reel adapted to carry a roll of the strip.

7. A machine according to claim 1 wherein said helicoid-forming means includes:

rotatable mandrel means of substantially circular cross-section having a second longitudinal axis, said second longitudinal axis being disposed at right angles to said first longitudinal axis;

drive means attached to said mandrel for the rotation thereof; and adjustment means attached to said tube-forming means for the aligning thereof with respect to said mandrel means, so as to align said tube substantially tangentially with the diameter of said mandrel means.

8. A machine according to claim 7 further comprising adjustable guide means disposed on said mandrel means for translational guidance thereof upon rotation.

9. A machine according to claim 7 wherein said mandrel means is formed with a groove for receiving the helicoidal tube and shaped to substantially fit the circumference of said tube, wherein said drive means is an axle having a handle attached thereto, and further comprising longitudinally slidable and removable support means for said axle mounted on said frame.

10. A machine according to claim 1 further comprising strip-bending means for forming an initial portion of the strip into a substantially U-shaped portion for the feeding thereof into said slit, and wherein said slit has a substantially semi-circular shape.

* * * * *